US008448305B2

(12) United States Patent
Gallant et al.

(10) Patent No.: US 8,448,305 B2
(45) **Date of Patent: *May 28, 2013**

(54) ARRAYS OF FASTENER ELEMENTS

(75) Inventors: Christopher M. Gallant, Nottingham, NH (US); Mark A. Clarner, Concord, NH (US); Clinton Dowd, Goffstown, NH (US)

(73) Assignee: Valero Industries B.V., Willemstad, Curacao ( * ) Notice: Subject to any disclaimer, the term of this patent is extended or adjusted under 35 U.S.C. 154(b) by 0 days.

This patent is subject to a terminal disclaimer.

(21) Appl. No.: 13/533,107

(22) Filed: Jun. 26, 2012

(65) Prior Publication Data

US 2012/0266421 A1 Oct. 25, 2012

Related U.S. Application Data

(63) Continuation of application No. 12/167,538, filed on Jul. 3, 2008, now Pat. No. 8,225,467.

(60) Provisional application No. 60/947,919, filed on Jul. 3, 2007.

(51) Int. Cl.
*A44B 18/00* (2006.01)

(52) U.S. Cl.
USPC ..... 24/450; 24/452

(58) Field of Classification Search
USPC ..... 383/61.2, 206, 67, 86, 95; 24/452, 24/306, 450, 442, DIG. 38, DIG. 41, 444, 24/446, 447, 448, 449, 443, 451; 411/510
See application file for complete search history.

(56) References Cited

U.S. PATENT DOCUMENTS

| | | | |
|---|---|---|---|
| 3,076,244 | A | 2/1963 | De Mestral |
| 3,101,517 | A | 8/1963 | Marvin et al. |

(Continued)

FOREIGN PATENT DOCUMENTS

| | | | |
|---|---|---|---|
| DE | 20019333 | U1 | 2/2001 |
| EP | 567103 | B1 | 7/1997 |
| EP | 1749456 | B1 | 2/2008 |
| WO | WO0197738 | A3 | 4/2002 |

OTHER PUBLICATIONS

International Preliminary Report on Patentability for PCT/US2008/069233 mailed Dec. 9, 2009 (11 pages).

(Continued)

*Primary Examiner* — Robert J Sandy
*Assistant Examiner* — Rowland D Do
(74) *Attorney, Agent, or Firm* — Fish & Richardson P.C.

(57) ABSTRACT

A molded area fastener product, such as a self-engaging fastener, has a strip-form base of resin with a broad surface from which an array of discrete fastener elements extends. The fastener elements each include a molded stem extending from the broad surface of the base to a curved head that extends toward a front side of the fastener element, forms a crook and ends in a distal tip. In some examples the curved head protrudes beyond the stem on the back side of the fastener element to form an overhang defined by an overhang surface of the head directed toward the base, and the crook is defined in part by an underside head surface that overhangs a lower portion of the stem. In some examples the fastener elements are arranged to provide a high distension overlap when mated with an identical fastener product.

28 Claims, 8 Drawing Sheets

U.S. PATENT DOCUMENTS

| | | | | | |
|---|---|---|---|---|---|
| 3,266,113 | A | | 8/1966 | Flanagan | |
| 3,312,583 | A | | 4/1967 | Rochlis | |
| 3,557,413 | A | | 1/1971 | Engle | |
| 4,169,303 | A | | 10/1979 | Lemelson | |
| 4,426,816 | A | | 1/1984 | Dean et al. | |
| 4,665,557 | A | | 5/1987 | Kamp | |
| 4,677,697 | A | | 7/1987 | Hayes | |
| 4,829,641 | A | | 5/1989 | Williams | |
| 4,872,243 | A | | 10/1989 | Fischer | |
| 4,894,060 | A | * | 1/1990 | Nestegard | 604/391 |
| 4,929,225 | A | | 5/1990 | Ausnit et al. | |
| 4,984,339 | A | | 1/1991 | Provost et al. | |
| 5,067,210 | A | | 11/1991 | Keyaki | |
| 5,131,119 | A | | 7/1992 | Murasaki et al. | |
| 5,179,767 | A | | 1/1993 | Allan | |
| 5,235,731 | A | | 8/1993 | Anzai et al. | |
| 5,384,942 | A | | 1/1995 | Siegel | |
| 5,396,687 | A | | 3/1995 | Osterman | |
| 5,457,856 | A | | 10/1995 | Murasaki | |
| 5,640,744 | A | | 6/1997 | Allan | |
| 5,755,016 | A | * | 5/1998 | Provost | 24/452 |
| 5,797,170 | A | | 8/1998 | Akeno | |
| 5,799,378 | A | | 9/1998 | Gershenson et al. | |
| 6,131,251 | A | | 10/2000 | Provost | |
| 6,185,796 | B1 | | 2/2001 | Ausnit | |
| 6,367,128 | B1 | * | 4/2002 | Galkiewicz et al. | 24/585.1 |
| 6,375,647 | B1 | * | 4/2002 | Akeno et al. | 604/391 |
| 6,546,604 | B2 | | 4/2003 | Galkiewicz et al. | |
| 6,594,872 | B2 | | 7/2003 | Cisek | |
| 6,687,962 | B2 | | 2/2004 | Clarner et al. | |
| 6,746,434 | B2 | * | 6/2004 | Johnson et al. | 604/385.01 |
| 6,991,375 | B2 | | 1/2006 | Clune et al. | |
| 7,340,807 | B2 | | 3/2008 | Dais et al. | |
| 2002/0053119 | A1 | | 5/2002 | Provost et al. | |
| 2003/0031386 | A1 | | 2/2003 | Shepard et al. | |
| 2003/0192152 | A1 | * | 10/2003 | Zoromski et al. | 24/446 |
| 2004/0167456 | A1 | | 8/2004 | Kingsford et al. | |

OTHER PUBLICATIONS

International Search Report; Written Opinion of the International Searching Authority for PCT/US2008/069233 mailed Dec. 23, 2008.

* cited by examiner

ARRAYS OF FASTENER ELEMENTS

CROSS-REFERENCE TO RELATED APPLICATIONS

This U.S. patent application is a continuation of, and claims priority under 35 U.S.C. 120 from, U.S. Ser. No. 12/167,538, filed Jul. 3, 2008, which claims priority under 35 U.S.C. 119(e) from U.S. provisional patent application 60/947,919, filed Jul. 3, 2007. The entire contents of these priority patent applications are hereby incorporated by reference.

TECHNICAL FIELD

This invention relates to fastener products having arrays of discrete male fastener elements that engage arrays of male fastener elements to form a fastening, to articles incorporating such elements, and to methods of making such elements.

BACKGROUND

Area fastener products (i.e., those that engage over an overlapped area) include adhesives and hook-and-loop fasteners. Another type of area fastener product has an array of discrete male projections that interlock with male projections of a related product. This latter type of fastener is sometimes referred to as 'self-engaging,' particularly when the fastener elements of each product are of a similar size and shape. Many self-engaging fastener products employ mushroom-type fastener elements, having heads that overhang in multiple directions. Such mushroom fastener elements are arranged with sufficient density that edges of mating mushrooms snap past each other during engagement.

Self-engaging fastener (SEF) products are generally considered to exhibit high shear and tension resistance, and require higher force for engagement, than typical hook-and-loop fasteners. During disengagement of SEF products by peel it is common to experience a peel force ripple and associated noise, as individual fastener elements snap out of engagement. However, such products can also be desirable in many low-load applications, such as those in which loop fibers are not desired.

Improvements in area fastener products employing male-male fastener element engagement are desired.

SUMMARY

Various aspects of the invention feature an area fastener product with a strip-form base of resin having a broad surface from which an array of discrete fastener elements extends. The base and fastener elements together form a unitary and seamless mass of resin, preferably a molded mass. The fastener elements each have a molded stem extending from the broad surface of the base to a curved head that extends toward a front side of the fastener element. The head forms a crook and ends in a distal tip, the crook defined in part by an underside head surface that overhangs a lower portion of the stem.

According to one aspect of the invention, the curved head protrudes beyond the stem on the back side of the fastener element (opposite its front side) to form an overhang defined by an overhang surface of the head directed toward the base.

In some preferred embodiments, the stem tapers in width, such as measured between the front and back sides of the fastener element.

In some embodiments the head has an upper surface that extends from the tip to the overhang surface without inflection. In some cases, the upper surface forms a smooth, inflection-free curve from tip to overhang surface. For example, the upper surface may follow a radius from tip to overhang surface, and the center of curvature the upper surface of the curved head can be approximately centered over a lower portion of the stem, for example, between front and rear stem fillets, such that a highest elevation of the curved head is also approximately centered over the lower stem portion.

In some arrangements the distal tip is directed toward the base, and can be molded to be so directed, such as in a mold cavity of such shape.

Preferably, a rearmost extent of the curved head extends rearward of the foremost extent of the back side of the stem by an overhang distance, measured parallel to the broad surface of the base, of at least about 10 percent of an overall width of the curved head, measured parallel to the base. The overhang distance is preferably less than about 30 percent of the overall width of the curved head.

The stem preferably has a width, measured parallel to the base fore-aft at an elevation of the foremost extent of the back side of the stem, that is greater than about 50 percent of the overall width of the curved head, measured parallel to the base.

In some embodiments, the fastener elements are arranged in the array to provide a distension overlap of at least 30 percent (preferably, at least 50 percent, and more preferably, at least 75 percent) when mated with an identical fastener product. By 'distension overlap' we mean the ratio of distension length to pitch spacing, as discussed below with respect to FIG. 6. This ratio has some relevance to the overlap of the disengagement peel forces of consecutive fastener element pairings, with higher distension overlap tending to provide smoother peel resistance.

In some examples, each fastener element has planar lateral sides interconnecting its front and rear sides. The lateral sides in some cases are parallel and extend from the broad surface of the base to an uppermost extent of the curved head of the fastener element. The front and rear sides of some fastener elements intersect their lateral sides at right angles.

In some cases, the array of fastener elements includes parallel rows and parallel columns of fastener elements forming an orthogonal array, with the curved heads of the fastener elements directed along their respective columns. For some applications, the heads of the fastener elements in adjacent columns are directed in opposite directions. In some arrangements, the curved heads of the adjacent fastener elements of the row only partially overlap when viewed along the row, such that the tips of two adjacent fastener elements of the row are visible from the end of the row.

The fastener elements may be arranged in various configurations. In one example configuration, discussed below with respect to FIG. 12, each row of fastener elements includes a pattern 110011001100, where '1' represents a column having fastener element in that row, and '0' represents a column not having a fastener element in that row.

In some other applications the heads of substantially all of the fastener elements are directed in a common direction. In some cases, the stems of adjacent fastener elements of a row are aligned in a direction perpendicular to their columns.

Some embodiments also include one or more shear stops extending from the broad surface of the base between rows of fastener elements and positioned to engage heads of molded fastener elements of a mated, identical fastener product, to resist movement relative to the mated product along the row. Each shear stop preferably extends to a height above the broad surface that is less than half of a height of the fastener elements above the broad surface. Preferably, the shear stops are so short as to not preclude engagement of adjacent fastener elements. Some examples have multiple shear stops dispersed within the array at a shear stop density of one per 25 to 100 fastener elements.

In some embodiments, adjacent fastener elements of each column are spaced apart according to a pitch spacing less than twice an overall width of the head, measured along the column.

The fastener element heads of adjacent columns in some examples are spaced apart by a gap width less than their thickness measured perpendicular to their columns.

In some examples, the overhang surface on the back side of the fastener element defines an inflection point between an upper surface of the curved head and a curved back surface of the stem. In some cases the curved back surface of the stem and the upper surface of the curved head each define a similar radius of curvature.

In some configurations, the front and back sides of the fastener element join the base at curved fillets.

In some examples, the stem and curved head together form a single continuous projection from base to tip, defining a constantly narrowing flow thickness. In some cases the curved head defines a flow thickness, measured at a rearmost extent of the crook, that is less than half of an overall lateral thickness of the head.

Various examples can be configured with additional features and functions. For example, in some cases the curved head has an electrically conductive upper surface, such as for providing a conductive fastening when mated.

The fastener elements are preferably shaped and arranged such that the product will releasably engage in either of two opposite orientations with a like product.

For many applications, the fastener elements extend to a height of less than about 0.050 inch (1.25 mm) from the broad surface of the base, and the array preferably has a fastener element density of more than 2,000 fastener elements per square inch (300 per square centimeter) for some applications, although the fastener elements may be scaled up and arranged in a density up to 200 per square inch (30 per square centimeter), for example, for other applications.

Another aspect of the invention features two of the fastener products as described above, releasably engaged to one another. Each fastener element of a first of the two products is disposed between respective adjacent fastener elements of a respective column of the second of the two. The heads of each of the fastener elements of each of the two products is disposed adjacent the broad surface of the base of the other of the two products, such that interference between the fastener elements of the two products resists separation of the products.

In many applications, the heads of the fastener elements of both of the products extend in a common direction.

In some embodiments, the tip of each fastener element of one product is directed toward the overhang surface of the back side of a respective, adjacent fastener element of the other product. In some cases, the tips and overhang surfaces of the adjacent fastener elements define a contact angle and static friction coefficient such that the crooks distend upon separation.

In some other embodiments, wherein the tip of each fastener element of one product is directed toward the front side of a respective, adjacent fastener element of the other product, such that the tips of the fastener elements interengage upon release to temporarily distend the crooks.

The bases of the two products are, in some examples, carried by flexible substrates, such that the releasably engaged products can be peeled apart by flexing the bases.

According to another aspect of the invention, the fastener elements are arranged in the array to provide a distension overlap of at least 30 percent (preferably, at least 50 percent, and more preferably, at least 75 percent) when mated with an identical fastener product. In some examples of this aspect of the invention, the curved head protrudes beyond the stem on a back side of the fastener element to form an overhang defined by an overhang surface of the head directed toward the base, and/or the crook formed by the curved head is defined in part by an underside head surface that overhangs a lower portion of the stem.

Another aspect of the invention features two area fastener products in which the arrays of fastener elements are releasably engageable with one another upon a normal engagement pressure to form a fastening in which each fastener element of a first of the two being disposed between respective adjacent fastener elements of the second of the two, the heads of each of the fastener elements of each of the two products being disposed partially beneath the heads of the other of the two products, such that interference between the fastener elements of the two products resists separation of the products. The fastening resists normal separation with a separation resistance, the normal engagement pressure being less than 80 percent (preferably, less than 75 percent or even around 60 percent) of the separation resistance.

By 'normal engagement pressure' we mean the minimum pressure required to fully engage the two arrays as they are brought together in a normal direction with their bases retained in a rigid, planar and parallel orientation. By 'separation resistance' we mean the minimum pressure required to subsequently separate the engaged arrays.

Another aspect of the invention features a method of forming fastener products of the type described herein, by pressing flowable resin into an array of blind cavities extending from a mold surface, cooling the resin to solidify molded fastener elements in the cavities and a layer of resin on the mold surface, and then stripping the resin layer from the mold surface along with the molded fastener elements from their cavities.

In some cases, the cavities are arranged to form fastener free lanes between columns or rows or sets of columns or rows of fastener elements.

Fastener products of the type described herein can be configured to provide a pleasingly smooth peel performance and a tactile confirmation of engagement and/or develop a substantially higher disengagement pressure than the pressure required for engagement. The fastener element arrays can enable some self-alignment of the arrays as they are brought into engagement, not only with respect to lateral displacement but also with respect to angulation, particularly with the fastener elements arranged in fully aligned rows and columns. The products can be readily made inexpensively in continuous fashion in molded form, for example. In many cases the fastener element arrays can be engaged in either of two opposite orientations.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
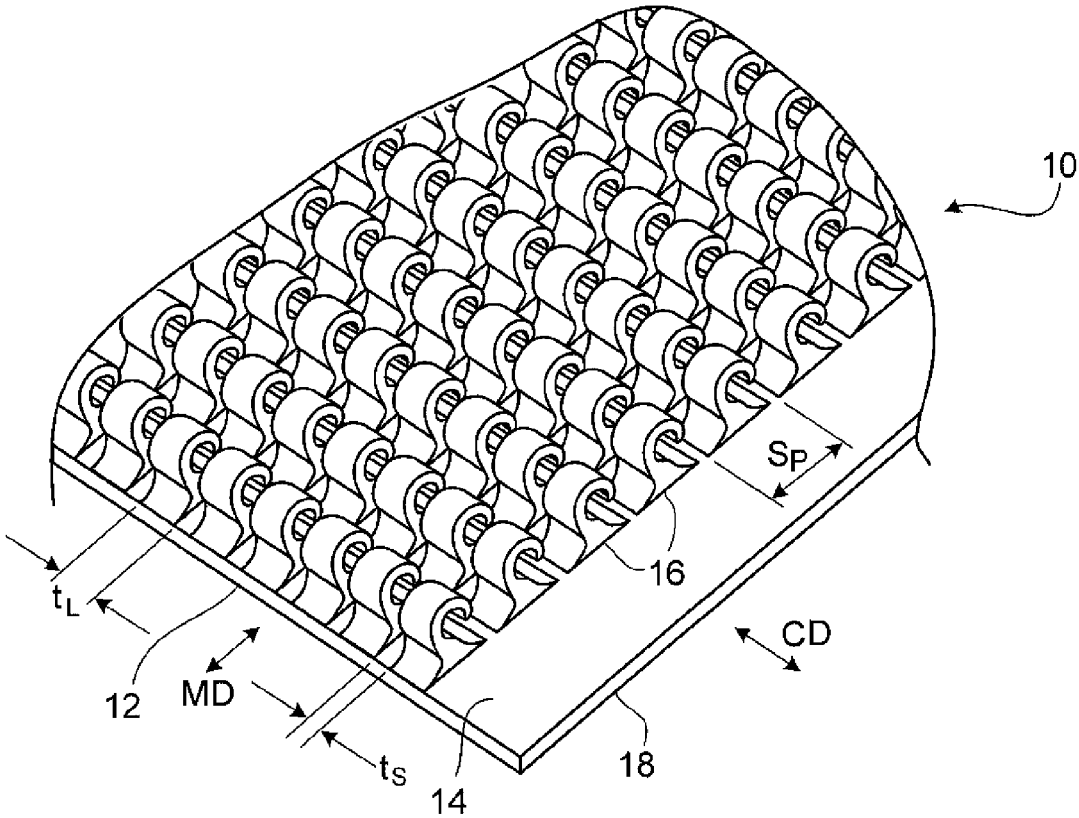
FIG. 1 is a perspective view of a portion of a first fastener product.

Referring first to FIG. 1, a first example of a strip-form or sheet-form fastener product 10 has a flexible base 12 of resin having a broad upper, fastening surface 14 from which an array of discrete fastener elements 16 extend. Base 10 and fastener elements 16 are preferably formed by a continuous molding process of a single flow of resin, such that the base and fastener elements together form a unitary and seamless resin mass, with the fastener elements extending contiguously and integrally with the upper surface of the base. Such a unitary structure can be molded, for example, using a rotating mold roll (not shown) defining a large number of discrete fastener element-shaped cavities about its periphery, as taught by Fischer in U.S. Pat. No. 4,872,243, the entire contents of which are incorporated herein by reference. The machine direction of such a process would normally be as illustrated by arrow 'MD', for example. In this view, one free longitudinal edge 18 of the base is shown, along with a corresponding selvedge 20 free of fastener elements.

In this configuration, fastener elements 16 are arranged in parallel rows and orthogonal columns, the columns extending in the machine direction MD, and the rows extending perpendicular to the columns, in the cross-machine direction CD. All fastener elements 16 face in a common machine direction, rather than in opposite directions. Adjacent rows are separated by fastener element-free lanes, such that one could look across the entire product in the cross-machine direction and see open space between adjacent fastener elements of the near column, as illustrated in the side view shown in FIG. 2 (reversed to show the fastener elements facing in the opposite direction).

Figure 3:
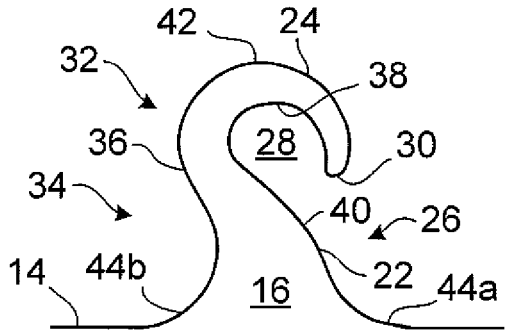
FIGS. 3 and 4 are enlarged side views of one of the fastener elements of the product of FIG. 1.

Referring next to FIG. 3, the fastener elements 16 each have a molded stem 22 tapering in width and extending from the broad surface 14 of base 12 to a curved head 24 that extends toward a front side 26 of the fastener element, forms a crook 28 and ends in a distal tip 30. Each fastener element 16 has a back side 32 opposite its front side. The curved head 24 protrudes beyond stem 22 on the back side 32 of the fastener element to form an overhang 34 defined by an overhang surface 36 of the head directed toward base 12 but not extending toward the base as does tip 30. The crook 28 formed by curved head 24 is defined in part by an underside head surface 38 that overhangs a lower portion 40 of stem 22. Curved head 24 has an upper surface 42 that extends from tip 30 to overhang surface 36 without inflection. In this example upper surface 42 forms a smooth, inflection-free curve from tip 30 to overhang surface 36, and follows a radius from the tip to the overhang surface, the radius having a center of curvature approximately centered over lower portion 40 of stem 22 between front and rear stem fillets 44*a* and 44*b*, such that a highest elevation of the curved head is also approximately centered over the lower stem portion. Tip 30 of the J-hook shape is 'reentrant' in the sense that it is directed downward toward the base of the product, rather than upward away from the base. The illustrated fastener elements 16 each define only one crook, with heads ending in only one tip, as opposed to palm tree type fastener elements each having a head extending equally in two opposite directions, defining two crooks and ending in two tips. The back side of fastener element 16 forms no crook.

Figure 2:
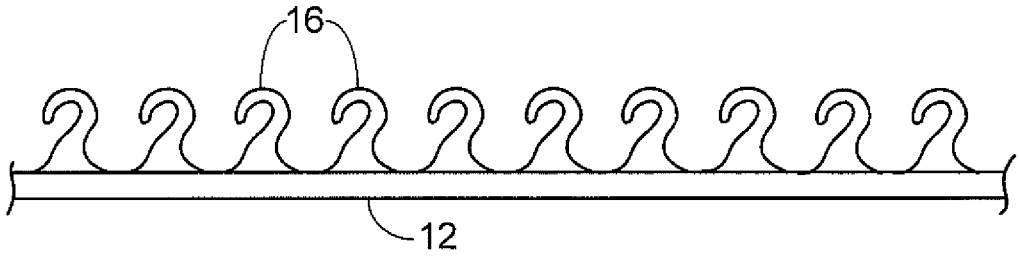
FIG. 2 is a side view of the fastener product of FIG. 1.
Figure 4:
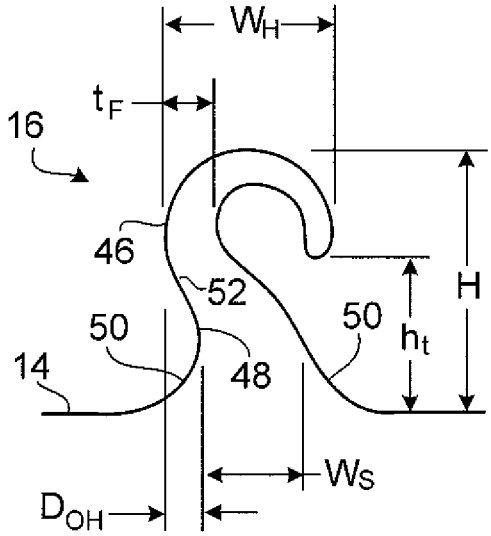

FIG. 4 illustrates some of the key dimensions and features of the fastener elements 16 of the shape shown in FIGS. 1-3. The rearmost extent 46 of curved head 24 extends rearward of the foremost extent 48 of the back side of the stem by an overhang distance $D_{OH}$, measured parallel to the broad surface 14 of the base, of 0.0025 inch (0.064 mm), which is more than about 10 percent of the overall width $W_H$ of curved head 24, measured parallel to the base, which in this example is 0.012 inch (0.3 mm). The stem has a width $W_S$, measured fore-aft parallel to the base at the elevation of the foremost extent 48 of the back side of the stem, of 0.0069 inch (0.18 mm). This stem width is greater than 50 percent of the overall curved head width $W_H$. The front and back sides of the fastener element join the upper surface 14 of the base at curved fillets 50. The fillet radius at the front side of the stem is 0.004 inch (0.1 mm), while the fillet radius at the back side of the stem is 0.006 inch (0.15 mm). The overhang surface on the back side of the fastener element defines an inflection point 52 between the upper surface of the curved head and the curved back surface of the stem formed by the rear fillet, such that the upper curved head surface and the curved stem surface blend together in a smooth, continuous curve. The curved back surface of the stem, as formed by the rear fillet, and the upper surface of the curved head each define a similar radius of curvature, the heads of the fastener elements nesting in the rear fillets of a mating fastener product.

The stem and curved head together form a single continuous projection from base surface 14 to tip 30, defining a constantly narrowing flow thickness so as to enable extraction from a similarly shaped mold cavity without cavity opening. The curved head defines a flow thickness $t_F$, measured at the rearmost extent 46 of the crook, of 0.0036 inch (0.09 mm). This flow thickness is less than half of the overall lateral thickness of the head (i.e., the dimension perpendicular to the view as shown in FIG. 4). As shown in the perspective view of FIG. 1, the lateral sides of fastener elements 16 are planar and parallel in this example, such that the overall lateral head thickness is the same as the overall lateral thickness $t_L$ of the fastener element and the only fastener element overhang is in the machine direction. In the example shown, $t_L$ is 0.008 inch (0.2 mm), the fastener elements being molded in complete form in cavities provided in mold rings of a similar thickness.

Still referring to FIG. 4, fastener elements 16 extend to a height H of only 0.0193 inch (0.5 mm), and have a tip height $h_t$ of about 0.0109 inch (0.28 mm). The tip has a tip radius of 0.0008 inch (0.02 mm). For many applications, the fastener element will have an overall height of less than about 0.050 inch (1.25 mm), measured from broad surface 14 of the base, and the dimensions provided may be scaled accordingly to produce fastener elements of an identical shape but of differing sizes.

Figure 5:
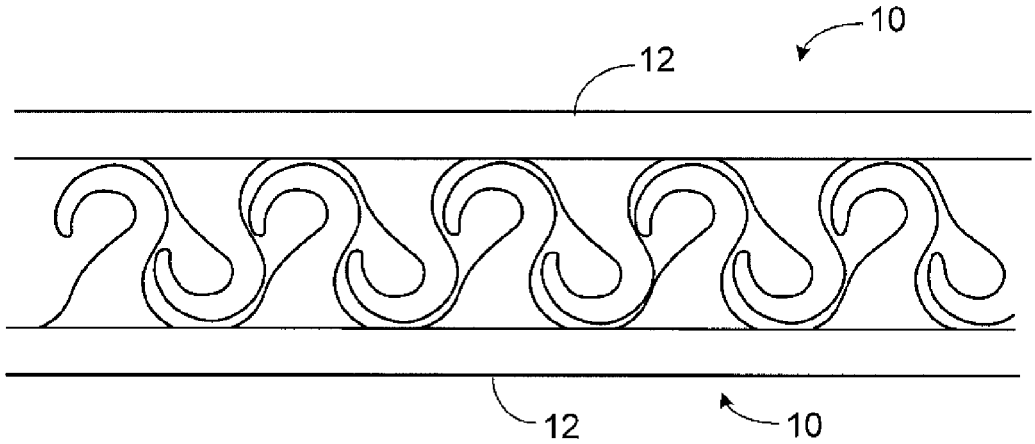
FIG. 5 is a side view of the product of FIG. 1 as mated with another such product.

Referring back to FIG. 1, the fastener elements 16 of each row are aligned such that their respective heads form spaced-apart portions of a segmented rib extending across the width of the product. When two such fastener products are brought together for engagement, as shown in FIG. 5, each row of fastener elements of one mated product is disposed between adjacent rows of fastener elements of the other mated product, as shown. In other words, the lanes between the rows or ribs of one product are sized and arranged to receive the rows or ribs of the other product. The fastener element arrays of each product are configured with identical spacing between rows and with identically sized and shaped fastener elements 16. In the illustrated example, the fastener elements of adjacent columns are separated by a spacing thickness $t_s$ of only about 0.004 inch (0.1 mm), or about one-half of the fastener element thickness. The fastener elements are arranged in an array having a fastener element density of 3,858 fastener elements per square inch (about 600 per square centimeter). Alternatively, with a spacing thickness of 0.006 inch (0.15 mm), the fastener element density is 3,307 fastener elements per square inch (about 512 per square centimeter). In this example the fastener element pitch spacing $S_p$ along each column is less than twice the overall width of the fastener element heads ($W_H$ in FIG. 4), such that when two identical products are mated, there is interference between the fastener element heads of the two products, and there must be temporary deformation of the fastener elements to achieve engagement.

Figure 6:
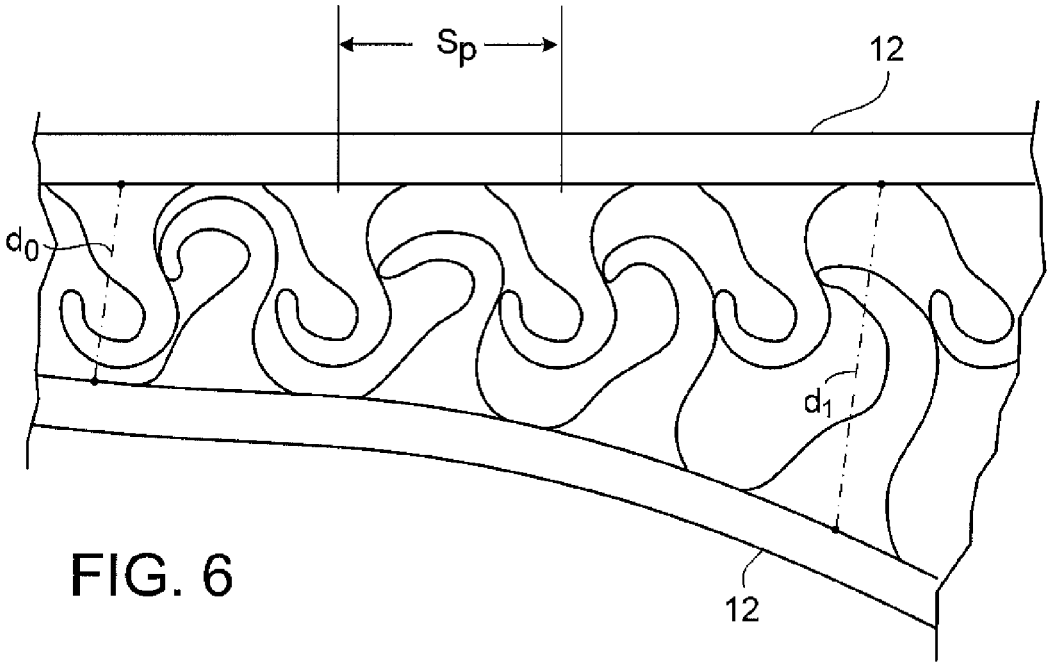
FIG. 6 illustrates the mated products of FIG. 5 being peeled apart.

In the mating engagement illustrated in FIG. 5 the fastener elements 16 of both mated products face in a common direction, with the front sides of the fastener elements of one product facing the back sides of the fastener elements of the other, and vice versa. FIG. 6 illustrates the progressive fastener element head deformation that occurs when such a mated arrangement is peeled apart in the machine direction. As one base 12 is flexed away from the other, the fastener elements 16 extending from that base are progressively distended, their tips pressing against, and remaining generally stationary with respect to, the back sides of corresponding fastener elements of the other product during the distension. As shown in FIG. 6, at any given instant in time there are multiple rows of fastener elements undergoing different stages of head distension. Subjectively, this progressive distension produces a rather smooth, pleasing peel force, in some cases feeling more like peeling off an adhesive surface than peeling apart an SEF closure. It is believed that the smoothness of the peel is at least in part a result of the relatively high distension length with respect to the fastener element pitch spacing. By 'distension length' we mean the difference in length of a line segment connecting the midpoint of a fastener element base with a midpoint of the respective spacing between fastener elements of the other product, between full engagement at rest (i.e., with no normal load applied), and the instant at which the tip disengages from the other fastener product during a standard peel test conducted in accordance with ASTM D 5170-98. In FIG. 6, such distances are approximately illustrated as $d_0$ and $d_1$. We call the ratio of this distension length ($d_1$-$d_0$) to pitch spacing $S_P$ the distension overlap. In other words, distension overlap is defined as ($d_1$-$d_0$)/$S_P$. For the product as illustrated in FIGS. 1-6 made from polypropylene, with a base thickness of about 0.006 inch (0.15 mm) this distension overlap is around 90 percent. It is believed that, all other parameters equal, the higher the distension overlap, the less peel force ripple will be perceived during disengagement, resulting in a smoother, more adhesive-like peel.

If a less smooth peel is desired, the tip-back engagement configuration can be modified (e.g., by altering the static coefficient of friction and/or engagement angle between the tips and fastener element backs), such that the fastener element crooks of the flexed product are compressed, rather than distended, to separate from the other product. In such a configuration, the tips of the moving fastener elements slide along the back surfaces of the other fastener elements, rather than remaining relatively stationary as illustrated. Such an arrangement is similar to many other self-engaging fastener products, in which each row of elements separates over a relatively narrow range of motion. In some such products, such as some rigid-head mushroom-shaped products, the interfering edges of the mating fastener elements 'snap' against each other both during engagement and disengagement. By way of contrast, the fastener elements shown in FIGS. 1-6 produce a tangible and tactile engagement 'bump' or 'snap' as they are brought into engagement face-to-face, while subsequently peeling apart with a very smooth feel.

One advantageous feature of the fastener element arrays described above is that they also enable engagement with the fastener elements of the two products facing in opposite directions, such that the tips of cooperating fastener elements face each other. Of course, separation from such an engagement involves slightly different mechanics, as will be discussed below.

As will be understood from FIGS. 1 and 5, the arrangement of fastener elements shown in FIG. 1 does not provide any appreciable resistance to lateral (i.e., cross-machine direction) shear loading. Under such loads, the mated products may simply slide across each other in the direction of their interleaved rows of fastener elements. However, the aligned-row arrangement of FIG. 1 does provide for substantial self-alignment between the mating products as they are brought together, particularly if engagement is initiated in one location and then progresses across the two arrays of fastener elements. In such cases, the linearity of the rows helps to promote alignment during such engagement progression. Also, the aligned-row arrangement of FIG. 1 does not require any alignment along the row for engagement.

Figure 7:
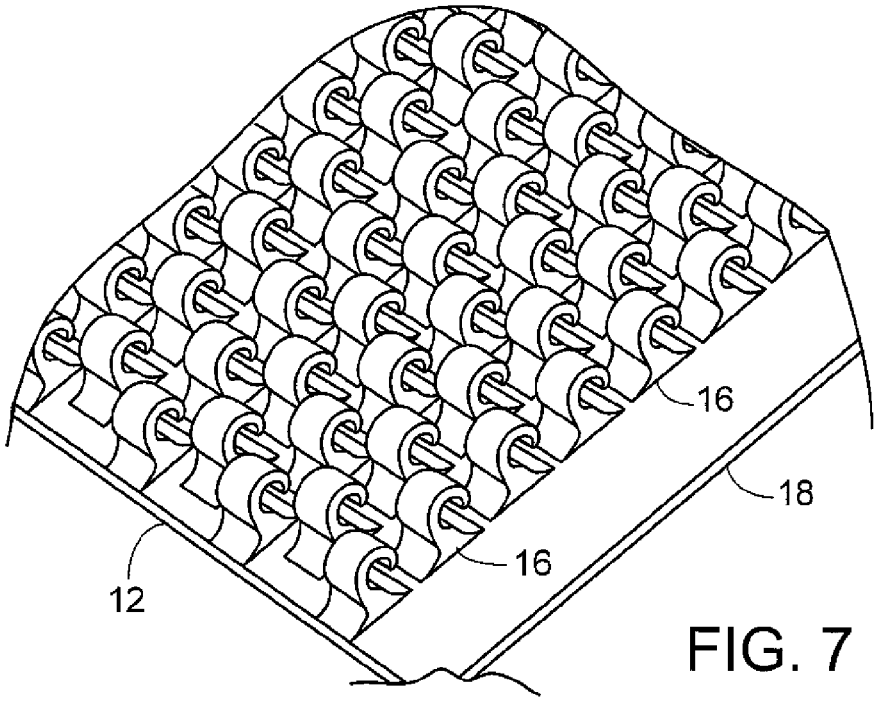
FIG. 7 is a perspective view of a portion of a second fastener product.

The fastener element arrangement of FIG. 7 addresses the issue of lateral shear loading resistance by staggering the columns of fastener elements, such that the fastener elements of adjacent rows are shifted in the machine direction with respect to one another. In the illustrated example the columns are shifted by one-half pitch spacing, producing a somewhat 'checker-board' arrangement of fastener elements. Engagement of such arrays does require some level of both machine direction and cross-machine direction alignment, at least at to the nearest fastener width and pitch spacing. In most instances such alignment will be minimal, given the very small nature of the fastener elements and their tight spacing. The issue of lateral shear loading resistance may alternatively be addressed with shear stops, as discussed below with respect to FIG. 9.

As illustrated in either of FIG. 1 or 7, the fastener elements are of such a large cross-machine thickness to height ratio that they are very resistant to both twisting out of their individual planes under load and to bending in a cross-machine direction. The stem of each fastener element is rather stout and stiff, and relatively resistant to bending or deformation in any direction, as compared with the crooks of the fastener elements that, while resistant to lateral bending and twisting, are relatively easy to distend.

Furthermore, because of the relatively high fastener element density and the stiffness of the individual fastener elements, the fastening surface of the product is very resistant to damage while remaining relatively smooth to the touch. Some earlier self-engaging fastener arrays required the stems flex to give enough room for the heads to slide past each other during disengagement, and more vulnerable to damage. Because the overhang is in the machine direction only, the fastener products of FIGS. 1 and 7 may be readily molded as a continuous tape according to the Fischer process, without requiring further processes to form heads on the fastener elements.

Figure 8:
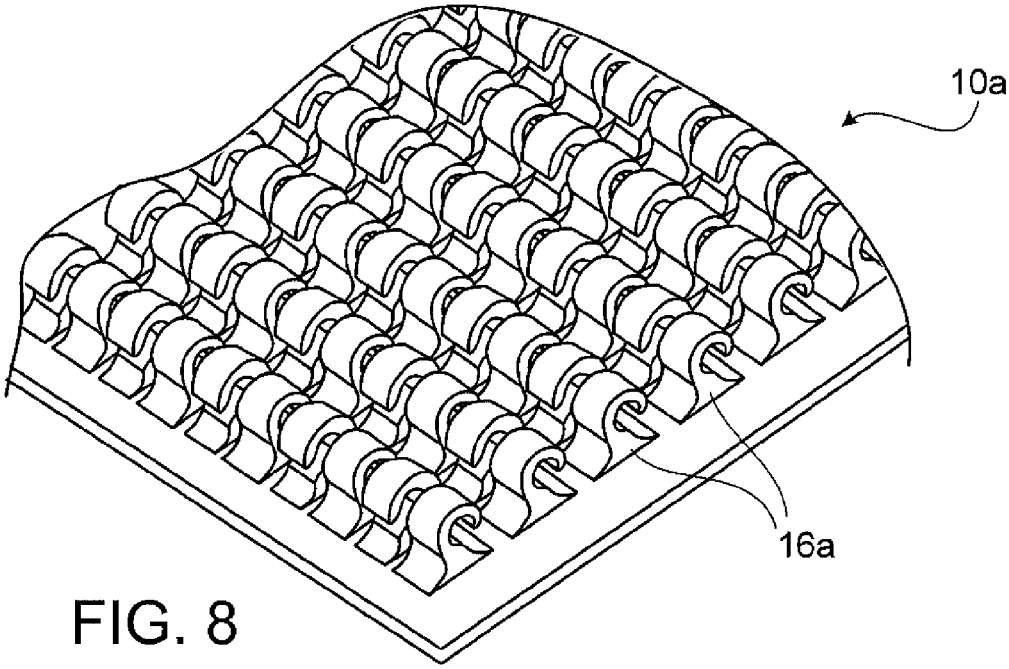
FIG. 8 is a perspective view of a portion of a third fastener product.
Figure 9:
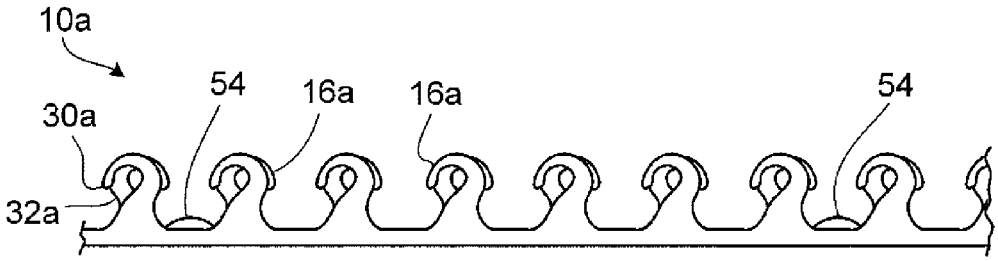
FIG. 9 is a side view of the fastener product of FIG. 8.

FIG. 8 shows another fastener product 10*a*, similar in many respects to the ones already described, but having fastener elements 16*a* of a slightly different shape and in which the fastener elements of adjacent columns face in opposite directions. The stems of the fastener elements of adjacent columns are aligned, however, such that the fastener elements form aligned rows with spaces between them, as in the arrangement of FIG. 1. As shown in FIG. 9, however, because the fastener elements face in different directions, some of the tips of the fastener elements extend in one machine direction, and some in the opposite machine direction. Moreover, the shape of the fastener elements is such that the tips 30*a* extend longitudinally beyond the back sides 32*a* of the fastener elements of that row that face in the opposite direction, such that in side view tips facing in both directions are visible.

Figure 10:
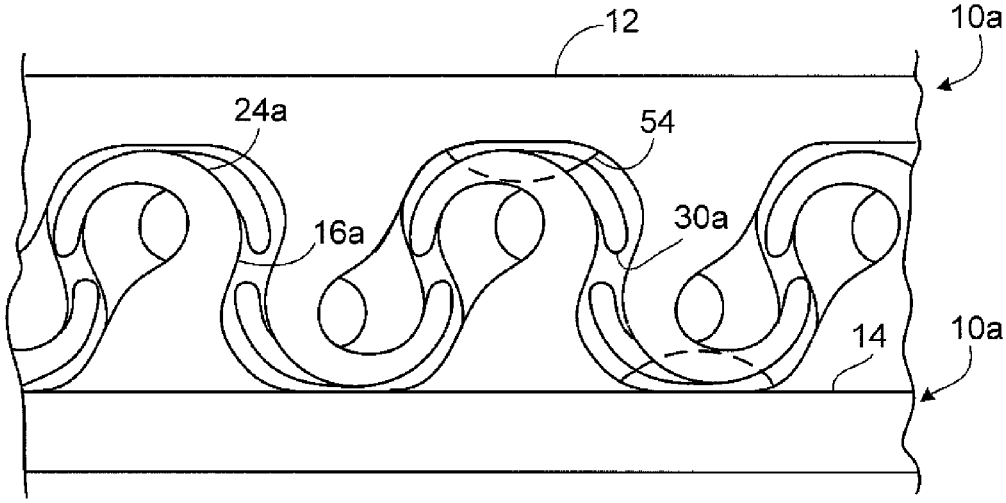
FIG. 10 is a side view of the product of FIG. 8 as mated with another such product.

The shapes and spacing of the fastener elements of product 10*a* are such that when two such products are brought into releasable engagement with their fastener elements in face-to-face orientation, as shown in FIG. 10, tips of one product overhang tips of the other product. Thus, during disengagement the overhanging tips engage one another and one or both of the fastener elements distend until released. With sufficient tip overlap, such release kinematics can result in a significant amount of fastener element distention, with the release force resistance acting over a broad separation travel distance, meaning that multiple rows of fastener elements can be undergoing different stages of peel separation at any given time, resulting in a pleasingly smooth, continuous release peel force as discussed above. For the array of elements as shown in FIG. 9, the distension overlap is about 65 to 70 percent when mated with an identical product with the fastener elements engaged tip-to-back (i.e., as in FIG. 5). When mated with an identical product with the fastener elements engaged tip-to-tip, as in FIG. 10, the distension overlap is about 100 percent. When arrays of such elements are configured as shown in FIG. 8, they can be engaged in practically any cross-machine relative position. In other words, they can be engaged with the fastener elements in tip-to-tip relation, or if moved slightly to one side or the other, with the fastener elements in tip-to-back relation. In either configuration, the fastener element arrays exhibit good engagement and peel properties and particularly good peel smoothness in subjective comparison with some other self-engaging fastener products. The slight undulation in head positions along each row means that with the fastener elements engaged in tip-to-tip relation there is more interference between mated fastener elements along each column than with the fastener elements engaged in tip-to-back relation, forcing the tips into an overlapped condition. The amount of this undulation can be set in relation to the fastener element shape so as to reduce any dependency of peel properties on engagement orientation.

The fastener elements 16*a* of each row in FIG. 8 are not quite aligned, such that their respective heads form spaced-apart portions of a segmented, undulating rib extending across the width of the product. The fastener elements are arranged in an array having a fastener element density of 3,158 fastener elements per square inch (about 490 per square centimeter) with a spacing thickness of 0.004 inch (0.1 mm). Alternatively, with a spacing thickness of 0.006 inch (0.15 mm), the fastener element density is 2,707 fastener elements per square inch (about 420 per square centimeter).

Figure 11:
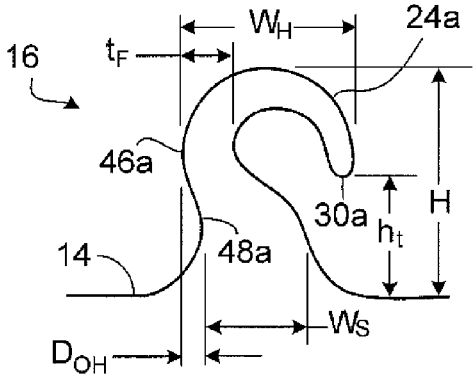
FIG. 11 is an enlarged side view of one of the fastener elements of the product of FIG. 8.

FIG. 11 illustrates some of the key dimensions and features of the fastener elements 16*a* of the shape shown in FIGS. 8-10. The rearmost extent 46*a* of curved head 24*a* extends rearward of the foremost extent 48*a* of the back side of the stem by an overhang distance $D_{OH}$, measured parallel to the broad surface 14 of the base, of 0.0015 inch (0.04 mm), which is again more than about 10 percent of the overall width $W_H$ of curved head 24*a*, measured parallel to the base, which in this example is 0.014 inch (0.36 mm). The stem has a width $W_S$, measured fore-aft parallel to the base at the elevation of the foremost extent 48*a* of the back side of the stem, of 0.0084 inch (0.21 mm). The front and back sides of the fastener element join the upper surface 14 of the base at curved fillets, which in this example have a radius of 0.006 inch (0.15 mm) at both the front and back sides of the stem.

As in the first-described fastener element shape, the stem and curved head together form a single continuous projection from base surface 14 to tip 30*a*, defining a constantly narrowing flow thickness so as to enable extraction from a similarly shaped mold cavity without cavity opening. The curved head defines a flow thickness $t_F$, measured at the rearmost extent 46*a* of the crook, of 0.0044 inch (0.11 mm). This flow thickness is only slightly greater than half of the overall lateral thickness of the head (i.e., the dimension perpendicular to the view as shown in FIG. 11). As shown in the perspective view of FIG. 8, the lateral sides of fastener elements 16*a* are also planar and parallel in this example, and the fastener elements each have an overall lateral thickness of 0.008 inch (0.2 mm).

Still referring to FIG. 11, fastener elements 16*a* extend to a height H of only 0.0193 inch (0.5 mm), and have a tip height $h_t$ of about 0.0107 inch (0.27 mm). For many applications, the fastener element will have an overall height of less than about 0.050 inch (1.25 mm), measured from broad surface 14 of the base, and the dimensions provided may be scaled accordingly to produce fastener elements of an identical shape but of differing sizes.

Referring back to FIG. 9, in this example resistance to lateral shear loading is provided by small shear stops 54 extending from the base between adjacent rows of fastener elements 16*a*. These small shear stops are configured as bump-shaped protrusions that are arranged to partially occupy space that would otherwise receive heads of the mating fastener elements, as shown in FIG. 10, and extend from the base far enough to interfere with lateral relative movement of the mated tapes. They are short enough that if the cross-machine alignment of the tapes when pressed together causes a fastener element head 24*a* to land on top of a shear stop 54, the fastener element crook compresses so as not to prevent the surrounding fastener elements from becoming engaged. When a lateral load is applied to the mated tapes along the direction of the rows, they slide until the fastener element heads are free of the shear stops, at which point the heads of the fastener elements spring back, such that lateral engagement of their lateral sides against lateral sides of the shear stops prevents further lateral movement. The lateral stiffness of the heads aids in this regard. Shear stops 54 can be of any shape, and can be molded to lie between adjacent columns of fastener elements, such as in cavities defined in rings otherwise spacing apart the fastener element mold rings in a mold roll.

Figure 12:
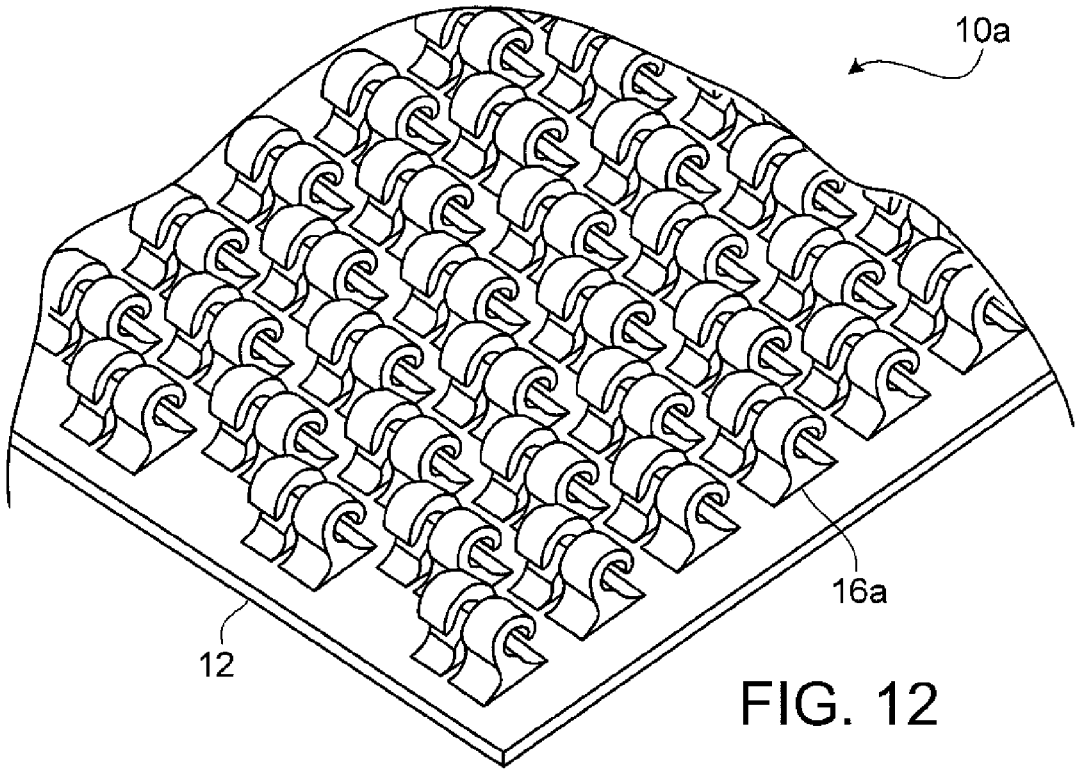
FIG. 12 is a perspective view of a portion of a fourth fastener product.

Referring to FIG. 12, fastener elements 16*a* can also be arranged in a pattern that prevents relative cross-machine displacement. In the pattern shown, the fastener elements are arranged in cooperative pairs, each pair comprised of two adjacent fastener elements of a row and facing in opposite directions. Together, each pair of fastener elements can be thought of as simulating a single 'arrow-head' feature, although the fastener elements of the pair are not joined except through base 12. The fastener element pairs are themselves arranged in a checkerboard pattern, such that each row of fastener elements includes a pattern 110011001100, where '1' represents a column having fastener element in that row, and '0' represents a column not having a fastener element in that row.

Figure 13:
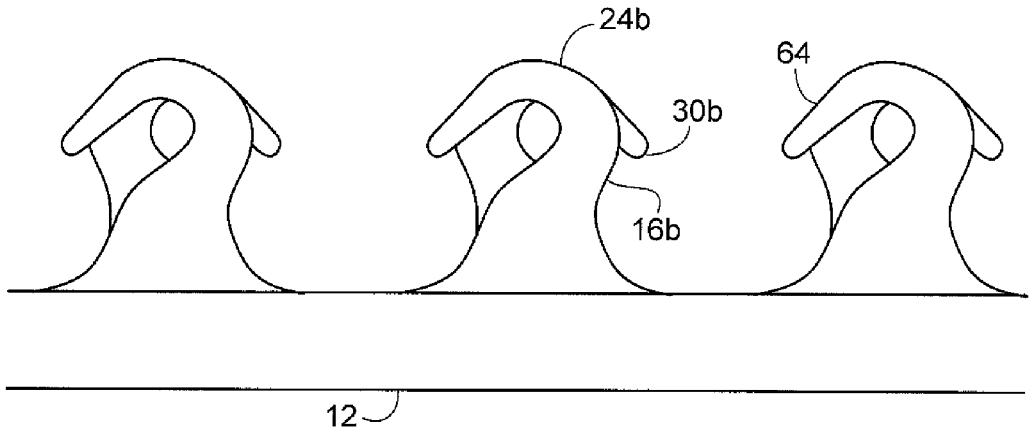
FIG. 13 is an enlarged side view of another fastener product.

FIG. 13 illustrates yet another fastener element shape 16*b*, similar to the one shown in FIG. 11 but with a slightly differing head shape. In this example the distal region 64 of the head 24*b* is rather straight, rather than curved, giving the fastener element an appearance somewhat like a bird, with the distal region of the head forming a bill. This fastener element shape is generally intended for tip-to-tip engagement. As with the arrangement of FIG. 10, the tips 30*b* extend beyond the adjacent fastener elements of the row.

The types of self-engaging fastener elements and fastener element arrays discussed above can be molded from various types of thermoplastic resins, such as polypropylenes, nylons and polyethylenes, to name a few. The fastener elements can also be molded from electrically conductive resins to make an electrically conductive closure. These products can also be molded from an elastomeric material, such as SARLINK or SANTOPRENE, to provide a closure that is virtually "silent" when engaging and disengaging. Elastomeric materials may also provide closures with very long cycle life.

It is also anticipated that the size of the features could be scaled up or down to adjust the relative strength of the closure, or for various applications. The closure strength can also be controlled by the stiffness of the resin used, and/or by eliminating fastener elements from the array. For example, a fastener product could have an array as shown in any of the above figures but in which a number of discrete elements, whether adjoining each other or spaced apart within the array, are removed.

Figure 14:
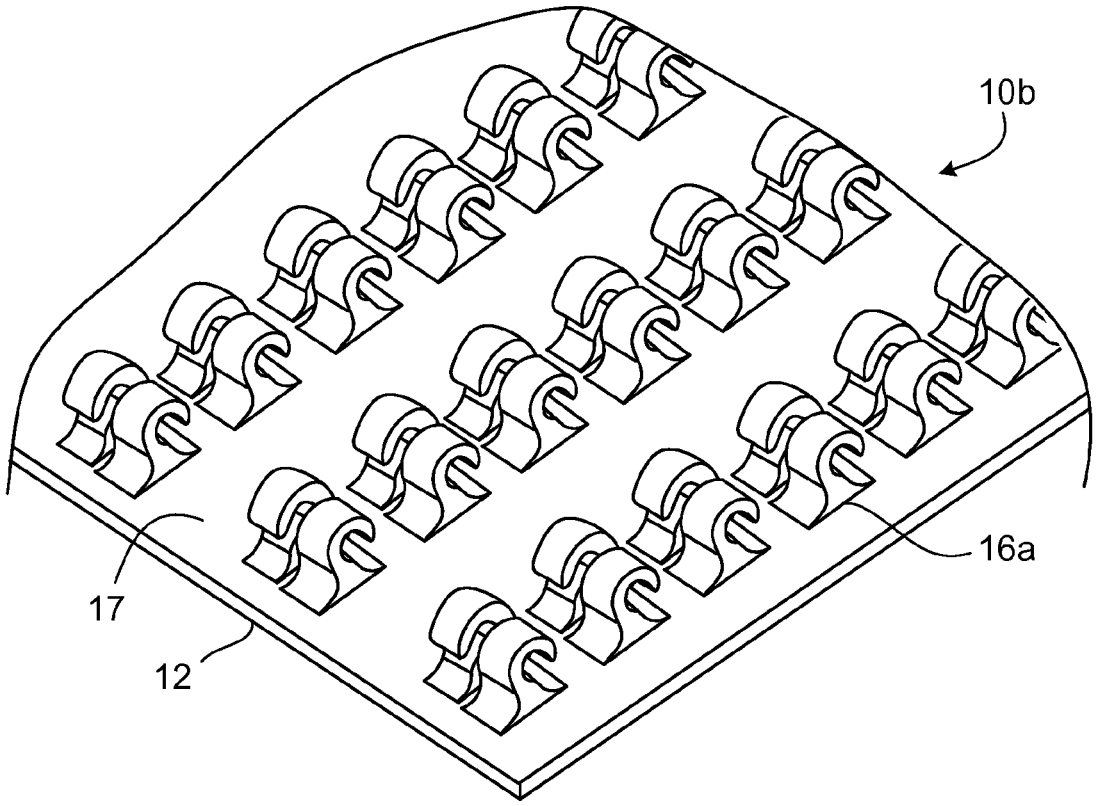
FIG. 14 is a perspective view of a portion of another fastener product.

As an example, FIG. 14 shows a configuration in which paired columns of fastener elements 16*a* are arranged in spaced apart lanes, to form a striped pattern. Stated otherwise, paired columns of fastener elements 16*a* are separated by fastener free lanes 17. Alternatively, paired or single columns or rows of fastener elements 16*a* may likewise be spaced apart by fastener free lanes. Such arrangements are generally suited for applications in which the mating arrays will be overlapped in generally parallel or near-parallel alignment. The striped pattern can provide visual indicia to help a user align opposing fastener elements 16*a*. Alignment can be further aided by alignment indicia such as lines printed on a surface of fastener product 10*b*. Alignment indicia can be preprinted on a film laminated to fastener product 10*b*, or may be printed on fastener product 10*b* at any suitable production stage. Similarly, alignment indicia may be formed using colored resin to form one or more rows of fastener elements 16*b*.

Such spaced rows of fastener elements 16*b* can further provide a notched or interrupted peel force, where that is desired, whereas maintaining a generally uniform fastener element density along the fastener strip generally maintains a constant peel performance while lowering overall peel strength.

Figure 15:
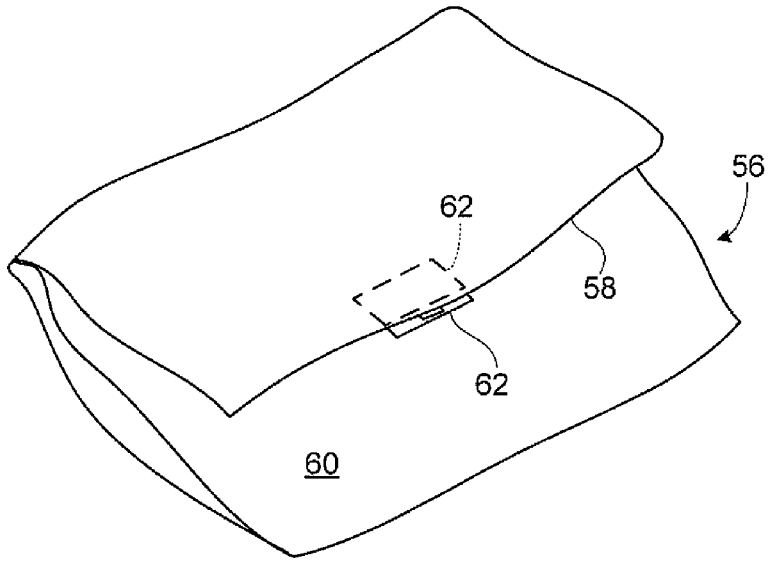
FIG. 15 is a perspective view of a pouch closed by a releasable fastener.

The fastener elements and arrays described above are generally best suited for applications in which the mating arrays will generally be overlapped in parallel, or near-parallel alignment. As an example, FIG. 15 shows a pouch 56, such as a tobacco pouch, that is configured with a flap 58 that is folded over the pouch for closure. Flap 58 and an adjacent side 60 of the pouch are provided with small patches 62 of fastener product of the type described above, positioned to substantially overlap when the flap is folded over the pouch. With the flap folded over, the fastener patches can be engaged by moderate pressure applied by thumb, for example, against the outer surface of the flap. In this manner, the fastener patches exhibit characteristics similar to pressure-sensitive adhesive patches, in that they require a bit of pressure (i.e., more than just touch) for activation, but then peel apart smoothly with little effort. As explained above, the fastener patches generally self-align and there is a tactile indication of engagement when pressed together.

Much of the above discussion has focused on peel as a mode of separating the fastener products with flexible bases, at least one of which is bonded or laminated to a flexible substrate, such that the base of at least one product flexes during disengagement. Another application of the above-described fastener products involves bonding or laminating both mating products to rigid substrates, such that the bases of the products remain relatively planar during both engagement and disengagement. In such cases engagement and disengagement are both typically accomplished by a force provided normal or perpendicular to the plane of engagement. In such applications these products can develop very high disengagement load resistance. The amount of disengagement resistance can be so high, in fact, that relatively small areas of engaged fasteners may be substantially unreleasable without tools but the products can be readily separated by sliding a thin sheet of metal between them. What is more, examples of the above-described products in rigid applications can be engaged with lower normal force than that required subsequently for disengagement, in some cases requiring for full engagement only about 60 percent of the disengagement resistance capacity. According to one test performed on the product as described above with respect to FIG. 8, mounted to rigid substrates and at a constant normal engagement and separation rate of about 0.09 inch per second (2.3 mm/sec), the product engaged at an average pressure of about 12 pounds per square inch (0.8 Kg/sq cm) and disengaged at an average pressure of about 20 pounds per square inch (1.4 Kg/sq cm).

The above-described fastener products may all be made in a continuous forming process involving a rotating mold roll with discrete, fastener element shaped cavities, as described in the Fischer patent mentioned above. For moldability, the illustrated fastener elements all have stems and heads that taper in width from base to tip. More specifically, each fastener element has a flow thickness or flow area, perpendicular to the flow of a flowable resin being forced into the cavity from base to tip, that continuously decreases from base to tip, such that the resin as molded may be extracted from the cavity without opening the cavity. The illustrated fastener products in which the fastener elements of a given row all face in one direction may also be manufactured according to profile extrusion methods known in the art of fastener product manufacture, such as by extruding a fastener element shaped rails on a continuous base and then severing the rails to form individual fastener elements. The severed fastener elements will differ from those of the fully molded type in that their opposing side surfaces will be of severed form, rather than having a resin 'skin' effect resulting from molding against a cooled surface. The severed elements can be spaced apart along their rows by stretching the base following severing, or by removing segments of each rail between elements, or by shrinking the extruded material after severing. Fastener elements formed by extrusion need not taper in width from base to tip.

While a number of examples have been described for illustration purposes, the foregoing description is not intended to limit the scope of the invention, which is defined by the scope of the appended claims. There are and will be other examples and modifications within the scope of the following claims.

What is claimed is:

1. An area fastener product comprising a strip-form base of resin having a broad surface from which an array of discrete fastener elements extends, the base and fastener elements together forming a unitary and seamless mass of resin, the fastener elements each comprising a molded stem tapering in width and extending from the broad surface of the base to a curved head that extends toward a front side of the fastener element, forms a crook and ends in a distal tip, wherein each fastener element has a back side opposite its front side;

the curved head protrudes beyond the stem on the back side of the fastener element to form an overhang defined by an overhang surface of the head directed toward the base; and wherein the crook formed by the curved head is defined in part by an underside head surface that is disposed directly over a lower portion of the stem;

the distal tip is directed toward the base;

the array of fastener elements comprises parallel rows and parallel columns of fastener elements, the curved heads of the fastener elements directed along their respective columns; and wherein adjacent fastener elements of each column are spaced apart according to a pitch spacing less than twice an overall width of the head, measured along the column.

2. The fastener product of claim 1, wherein the head has an upper surface that extends from the tip to the overhang surface without inflection.

3. The fastener product of claim 2, wherein the upper surface forms a smooth, inflection-free curve from tip to overhang surface.

4. The fastener product of claim 1, wherein a rearmost extent of the curved head extends rearward of a foremost extent of the back side of the stem by an overhang distance, measured parallel to the broad surface of the base, of at least about 10 percent of an overall width of the curved head, measured parallel to the base.

5. The fastener product of claim 1, wherein a rearmost extent of the curved head extends rearward of the foremost extent of the back side of the stem by an overhang distance, measured parallel to the broad surface of the base, of less than about 30 percent of an overall width of the curved head, measured parallel to the base.

6. The fastener product of claim 1, wherein the stem has a width, measured parallel to the base fore-aft at an elevation of the foremost extent of the back side of the stem, that is greater than about 50 percent of an overall width of the curved head, measured parallel to the base.

7. The fastener product of claim 1, wherein the fastener elements are arranged in the array to provide a distension overlap of at least 30 percent when mated with an identical fastener product.

8. The fastener product of claim 1, wherein each fastener element has planar lateral sides interconnecting its front and rear sides.

9. The fastener product of claim 1, wherein the heads of the fastener elements in adjacent columns are directed in opposite directions.

10. The fastener product of claim 1, further comprising a shear stop extending from the broad surface of the base between rows of fastener elements and positioned to engage heads of fastener elements of a mated, identical fastener product, to resist movement relative to a mated product along the row.

11. The fastener product of claim 1, wherein the fastener element heads each has a thickness measured perpendicular to its respective column, and wherein fastener element heads of adjacent columns are spaced apart by a gap width less than their thickness.

12. The fastener product of claim 1, wherein the overhang surface on the back side of the fastener element defines an inflection point between an upper surface of the curved head and a curved back surface of the stem.

13. The fastener product of claim 1, wherein the stem and the curved head together form a single continuous projection from base to tip, defining a constantly narrowing flow thickness.

14. The fastener product of claim 1, wherein the curved head defines a flow thickness, measured at a rearmost extent of the crook, that is less than half of an overall lateral thickness of the head.

15. The fastener product of claim 1, wherein the fastener elements are shaped and arranged such that the product will releasably engage in either of two opposite orientations with a like product.

16. In combination, two releasably engaged fastener products, each fastener product comprising a strip-form base of resin having a broad surface from which an array of discrete fastener elements extends, the base and fastener elements together forming a unitary and seamless mass of resin, the fastener elements each comprising a molded step tapering in width and extending from the broad surface of the base to a curved head that extends toward a front side of the fastener element, forms a crook and ends in a distal tip, wherein each fastener element has a back side opposite its front side;

the curved head protrudes beyond the stem on the back side of the fastener element to form an overhang defined by an overhang surface of the head directed toward the base; and wherein the crook formed by the curved head is defined in part by an underside head surface that is disposed directly over a lower portion of the stem, and the distal tip is directed toward the base;

wherein each fastener element of a first of the two is disposed between respective adjacent fastener elements of a respective column of the second of the two, the heads of each of the fastener elements of each of the two products being disposed adjacent the broad surface of the base of the other of the two products, such that interference between the fastener elements of the two products resists separation of the products.

17. The combined fastener products of claim 16, wherein the heads of the fastener elements of both of the products extend in a common direction.

18. The combined fastener products of claim 16, wherein the tip of each fastener element of one product is directed toward the overhang surface of the back side of a respective, adjacent fastener element of the other product.

19. The combined fastener products of claim 16, wherein the tip of each fastener element of one product is directed toward the front side of a respective, adjacent fastener element of the other product, such that the tips of the fastener elements interengage upon release to temporarily distend the crooks.

20. The combined fastener products of claim 16, wherein the arrays of fastener elements are releasably engageable with one another upon a normal engagement pressure to form a fastening in which each fastener element of a first of the two being disposed between respective adjacent fastener elements of the second of the two, the heads of each of the fastener elements of each of the two products being disposed partially beneath the heads of the other of the two products, such that interference between the fastener elements of the two products resists separation of the products; and wherein the fastening resists normal separation with a separation resistance, the normal engagement pressure being less than 75 percent of the separation resistance.

21. An area fastener product comprising strip-form base of resin having a broad surface from which an array of discrete fastener elements extends, the base and fastener elements together forming a unitary and seamless mass of resin, the fastener elements each comprising a molded stem tapering in width and extending from the broad surface of the base to a curved head that extends toward a front side of the fastener element, forms a crook and ends in a distal tip, wherein each fastener element has a back site opposite its front side;

the curved head protrudes beyond the stem on the back side of the fastener element to form an overhang defined by an overhang surface of the head directed toward the base; and wherein the crook formed by the curved head is defined in part by an underside head surface that is disposed directly over a lower portion of the stem;

the distal tip is directed toward the base; and wherein the fastener elements are arranged in the array to provide a distension overlap of at least 30 percent when mated with an identical fastener product.

22. The fastener product of claim 21, wherein the array of fastener elements comprises parallel rows and parallel columns of fastener elements, the curved heads of the fastener elements directed along their respective columns.

23. The fastener product of claim 21, wherein the head has an upper surface that extends from the tip to the overhang surface without inflection.

24. The fastener product of claim 21, wherein a rearmost extent of the curved head extends rearward of a foremost extent of the back side of the stem by an overhang distance, measured parallel to the broad surface of the base, of at least about 10 percent of an overall width of the curved head, measured parallel to the base.

25. In combination, two fastener products according to claim 22, releasably engaged to one another, with each fastener element of a first of the two being disposed between respective adjacent fastener elements of a respective column of the second of the two, the heads of each of the fastener elements of each of the two products being disposed adjacent the broad surface of the base of the other of the two products, such that interference between the fastener elements of the two products resists separation of the products.

26. An area fastener product comprising a strip-form base of resin having a broad surface from which an array of discrete fastener elements extends, the base and fastener elements together forming a unitary and seamless mass of resin, the fastener elements each comprising a molded stein tapering, in width and extending from the broad surface of the base to a curved head that extends toward a front side of the fastener element, forms a crook and ends in a distal tip, wherein each fastener element has a back side opposite its front side;

the curved head protrudes beyond the stem on the back side of the fastener element to form an overhang defined by an overhang surface of the head directed toward the base, the curved head having a thickness measured perpendicular to its respective column;

the crook formed by the curved head is defined in part by an underside head surface that is disposed directly over a lower portion of the stem;

the distal tip is directed toward the base; and wherein the array of fastener elements comprises parallel rows and parallel columns of fastener elements, the curved heads of the fastener elements directed along their respective columns, and wherein fastener element heads of adjacent columns are spaced apart by a gap width less than their thickness.

27. In combination, two fastener products according to claim 26, releasably engaged to one another, with each fastener element of a first of the two being disposed between respective adjacent fastener elements of a respective column of the second of the two, the heads of each of the fastener elements of each of the two products being disposed adjacent to the broad surface of the base of the other of the two products, such that interference between the fastener elements of the two products resists separation of the products.

28. The combined fastener products of claim 27, wherein the arrays of fastener elements are releasably engageable with one another upon a normal engagement pressure to form a fastening in which each fastener element of a first of the two being disposed between respective adjacent fastener elements of the second of the two, the heads of each of the fastener elements of each of the two products being disposed partially beneath the heads of the other of the two products, such that interference between the fastener elements of the two products resists separation of the products; and wherein the fastening resists normal separation with a separation resistance, the normal engagement pressure being less than 75 percent of the separation resistance.

* * * * *

UNITED STATES PATENT AND TRADEMARK OFFICE

CERTIFICATE OF CORRECTION

PATENT NO. : 8,448,305 B2
APPLICATION NO. : 13/533107
DATED : May 28, 2013
INVENTOR(S) : Christopher M. Gallant et al.

It is certified that error appears in the above-identified patent and that said Letters Patent is hereby corrected as shown below:

On the Title Page (73) Assignee

Col. 1, Line 6, delete "Valero" and insert --Velcro--;

Claims

Col. 14, line 46, claim 16, delete "step" and insert --stem--;

Col. 15, line 28, claim 21, delete "strip-form" and insert --a strip-form--;

Col. 15, line 36, claim 21, delete "site" and insert --side--;

Col. 16, line 15, claim 26, delete "stein" and insert --stem--;

Col. 16, line 44, claim 27, before "the" delete "to".

Signed and Sealed this
Twenty-seventh Day of August, 2013

Teresa Stanek Rea
*Acting Director of the United States Patent and Trademark Office*